US006739109B1

(12) United States Patent
Fan

(10) Patent No.: US 6,739,109 B1
(45) Date of Patent: May 25, 2004

(54) SEALING DEVICE FOR A DISPOSABLE CUP

(76) Inventor: Jui CHuan Fan, Feng Yuan (TW)

( * ) Notice: Subject to any disclaimer, the term of this patent is extended or adjusted under 35 U.S.C. 154(b) by 37 days.

(21) Appl. No.: 10/323,999

(22) Filed: Dec. 20, 2002

(51) Int. Cl.[7] ..... B65B 7/28
(52) U.S. Cl. ..... 53/329.3; 53/300
(58) Field of Search ..... 53/329, 329.2, 53/329.3, 329.5, 300, 374.8

(56) References Cited

U.S. PATENT DOCUMENTS 3,378,991 A * 4/1968 Andersen ..... 53/329.3
3,628,301 A * 12/1971 Vermeulen ..... 53/329.3
3,724,161 A * 4/1973 Vermeulen ..... 53/329.2
4,092,817 A * 6/1978 Rist, III ..... 53/329.3
4,226,072 A * 10/1980 Balzer et al. ..... 53/329.5
5,272,854 A * 12/1993 Ye et al. ..... 53/329.2
5,577,370 A * 11/1996 Pajak et al. ..... 53/329.3

* cited by examiner

*Primary Examiner*—John Sipos

(57) ABSTRACT

A sealing device for a disposable cup is disclosed. The sealing device has a main body and the lateral wall of the main body is located at the sliding rail and is provided with a block body having a forward elevating sliding slot and the cup holding seat is provided with a through hole and the through hole has a size smaller than a hollow cylindrical body, and the bottom face of the hollow cylindrical body is protruded with two protruded securing sections, having provided each with an elevating and lowering block for mounting, a vertical through hole is obtained at the elevating and lowering block, and the through hole is positioned at the two ends at the bottom face of the holding platform, and the bottom end of the cylindrical body has a larger surface and the external side of the elevating and lowering device has a shaft with pulley.

3 Claims, 14 Drawing Sheets

SEALING DEVICE FOR A DISPOSABLE CUP

BACKGROUND OF THE INVENTION (a) Technical Field of the Invention

The present invention relates to a sealing device, and in particular, to a sealing machine which used to seal a disposable cup by means of a thermal pressing process.

(b) Description of the Prior Art

Referring to FIG. 1, there is shown a conventional sealing device 10 having a front side being mounted with a thermal pressing mechanism 15 for pressing a film 16 onto the edge of a disposable cup 19 so that the film 16 is adhered to the edge of the cup 19. A control box is secured to the top section of the thermal pressing mechanism 15 and is provided with a control panel 101 to control the operation of the sealing device 10. The disadvantage of this conventional sealing device 10 is that the sealing process is slow and is not convenient. This is because the design to retrieve the disposable cup 15 after the cup 15 has been sealed in laborious.

FIG. 2 is another conventional sealing device 20 having a thermal pressing mechanism 21 and a holding platform 24. A placing seat 26 is located below a through hole 25 of the holding platform 24. The disadvantage of this conventional sealing device is that the height of the cup is only limited to one specific size and if the height is too tall or too short, this sealing device 20 cannot be used to seal the cup, as shown in FIGS. 3 and 4.

Referring to FIG. 3, when a tall up 19 enters the sealing device 20, a safety blocking board 22 blocks the cup 19 from entering. Referring to FIG. 4, a short cup 19 cannot be lifted up by the placing seat 26 and it cannot conveniently remove the cup 19.

Accordingly, it is an object of the present invention to provide a sealing device for a disposable cup which can mitigate the drawbacks as shown above.

SUMMARY OF THE INVENTION

Accordingly, it is an object of the present invention to provide a sealing device for a disposable cup, wherein a through hole provided to a cup placing seat is provided with a hollow cylindrical body which can move upward and downward to simultaneously elevate or lower the cup placing seat, allowing user to access the cup for use.

An aspect of the present invention is to provide a sealing device for a disposable cup having a main body with a plurality of corresponding securing rods mounted at the two sides of the front thereof, and one side of the securing rod for mounting with a rolled film and a downward pulling-film end being surrounded to the securing rod and then being mounted onto the securing rod, a control box having a control panel being provided with a safety blocking plate beneath the control panel, a thermal pressing mechanism being mounted below the control box and the two side wall of the main body being engaged with a sliding rail having a front section being a holding platform, the center position of the holding platform being a through hole and the external edge of the through hole being a cup-placing seat, and the holding platform being connected to a transmission rod and the transmission rod caused the holding platform to move out from the main body or being pulled back to the main body characterized in that the lateral wall of the main body is located at the sliding rail and is provided with a block body having a forward elevating sliding slot and the cup holding seat is provided with a through hole and the through hole has a size smaller than a hollow cylindrical body, and the bottom face of the hollow cylindrical body is protruded with two protruded securing sections, having provided each with an elevating and lowering block for mounting, a vertical through hole is obtained at the elevating and lowering block, and the through hole is positioned at the two ends at the bottom face of the holding platform, and the bottom end of the cylindrical body has a larger surface and the external side of the elevating and lowering device has a shaft with pulley, when the holding platform is driven to/or away from the main body, the individual pulleys enter the sliding slot and cause the second hollow cylindrical body to move upward or downward, if the hollow cylindrical body moves upward, the sealed cups are lifted up and when at lowering, the edge of the cup is placed onto the through hole of the cup-placing seat to proceed with next sealing.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
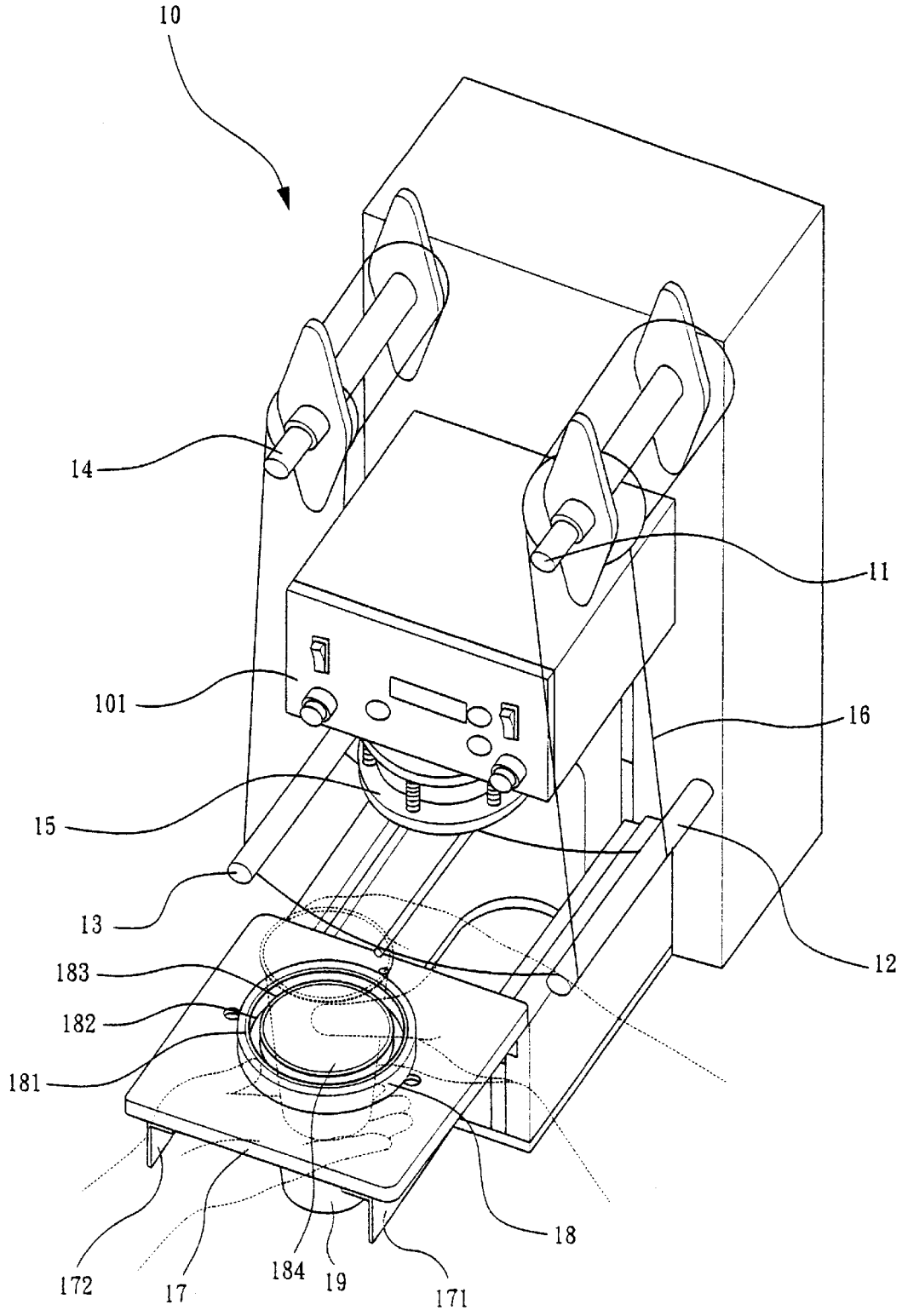
PRIOR ART FIG. 1
FIG. 1 is a conventional sealing device for sealing of a disposable cup.
Figure 2:
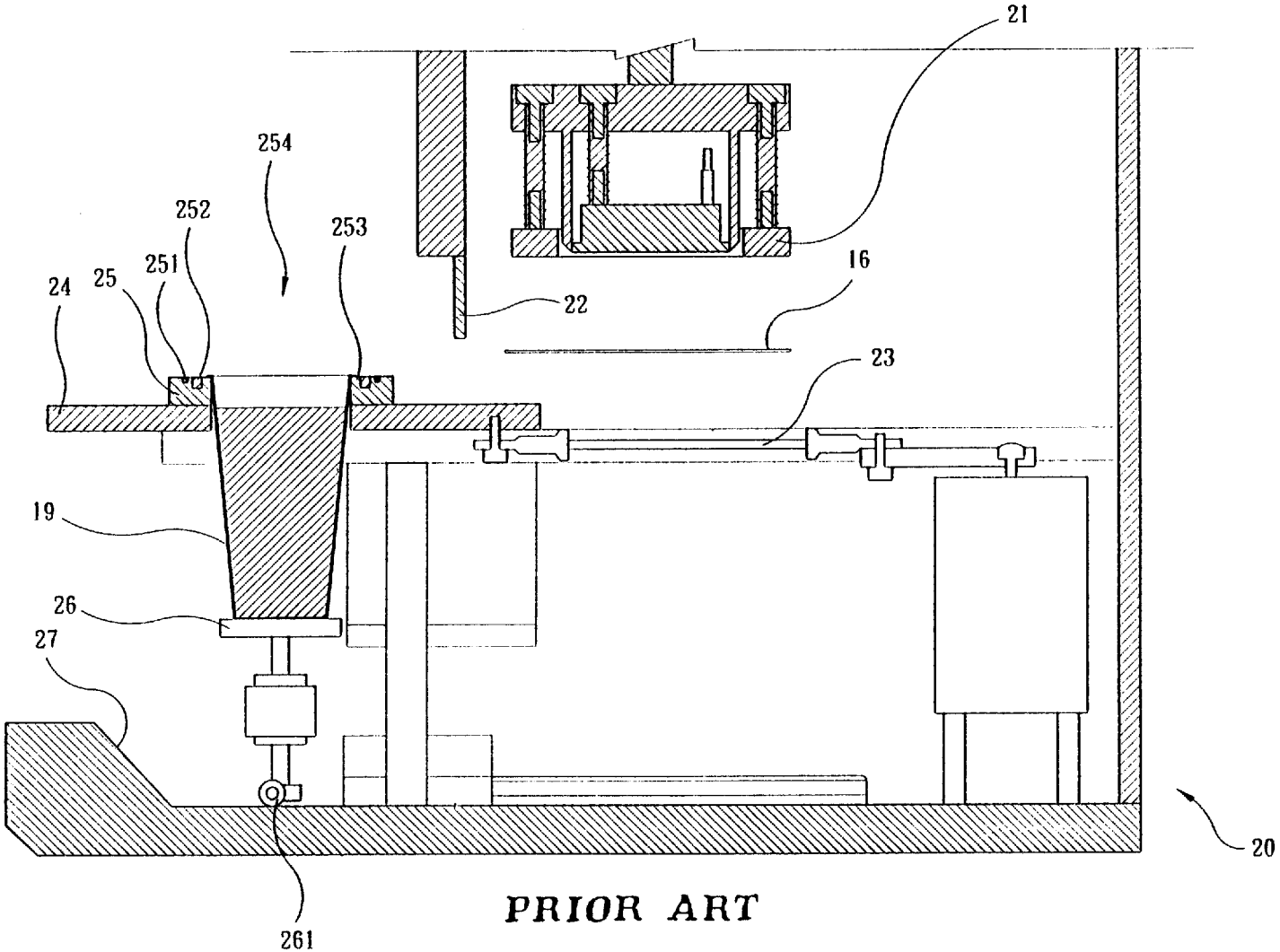
PRIOR ART FIG. 2
FIGS. 2, 3 and 4 are sectional views of a second conventional sealing device for sealing of a disposable cup.
Figure 3:
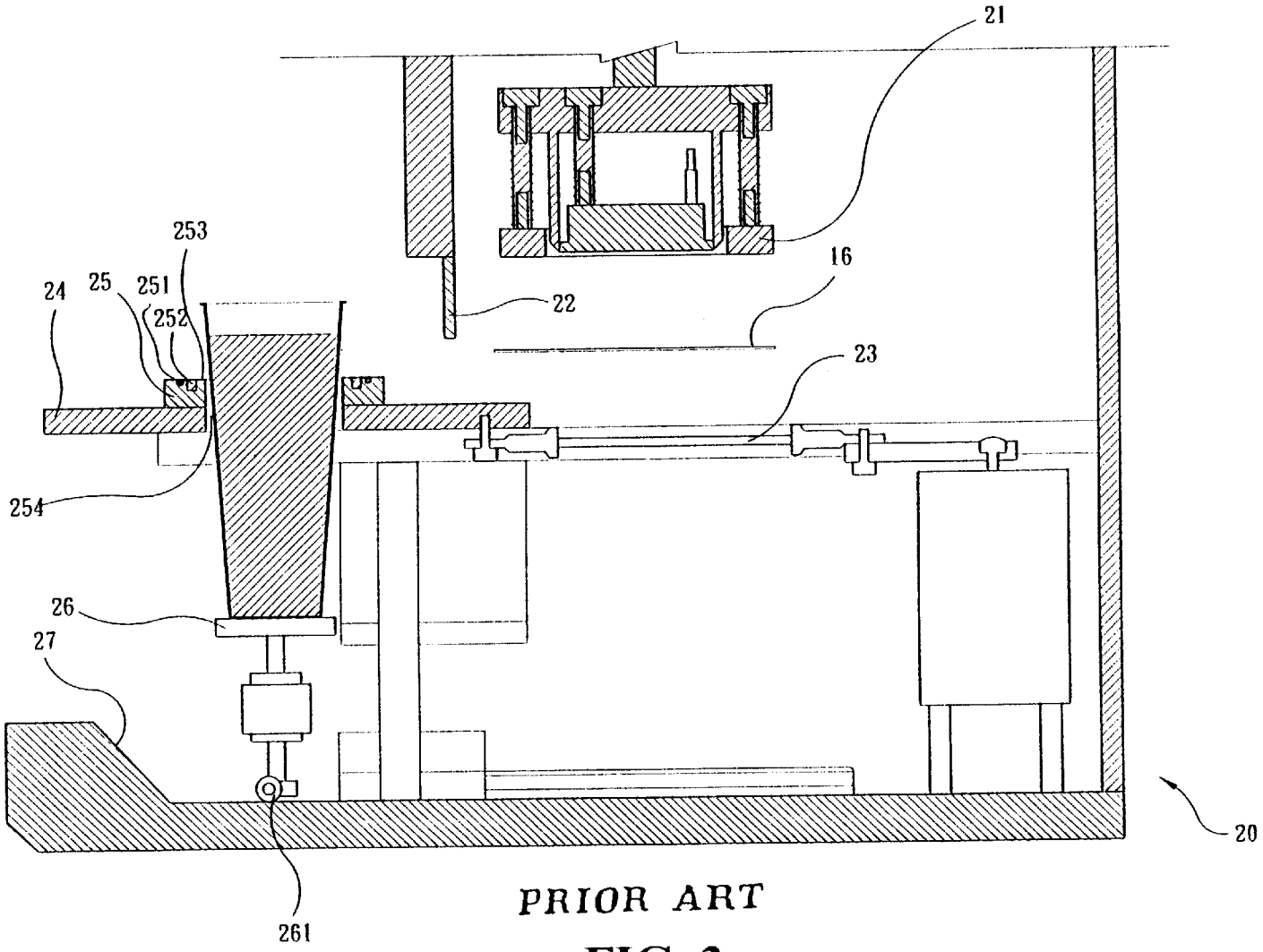
PRIOR ART FIG. 3
Figure 4:
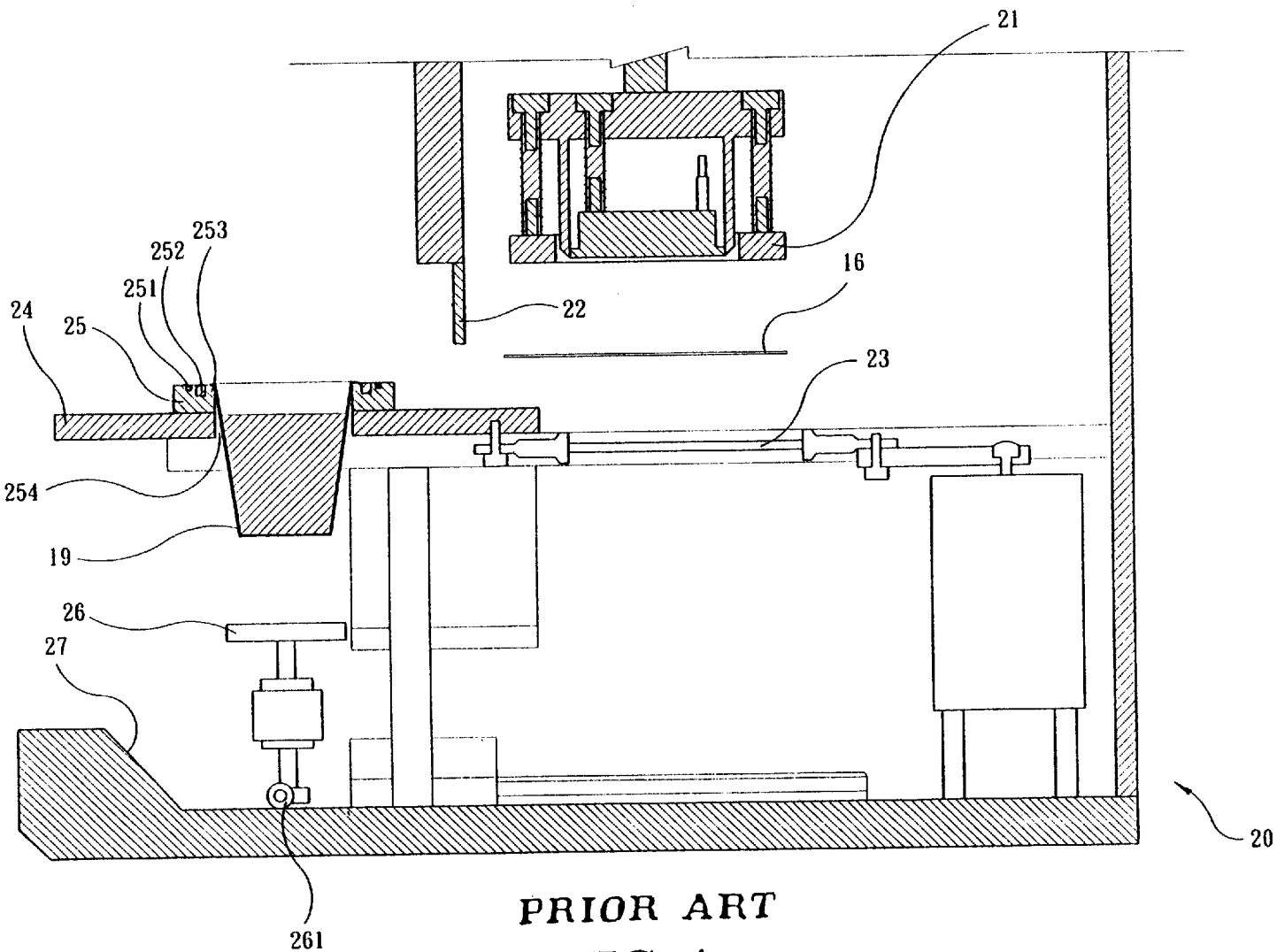
PRIOR ART FIG. 4
Figure 5:
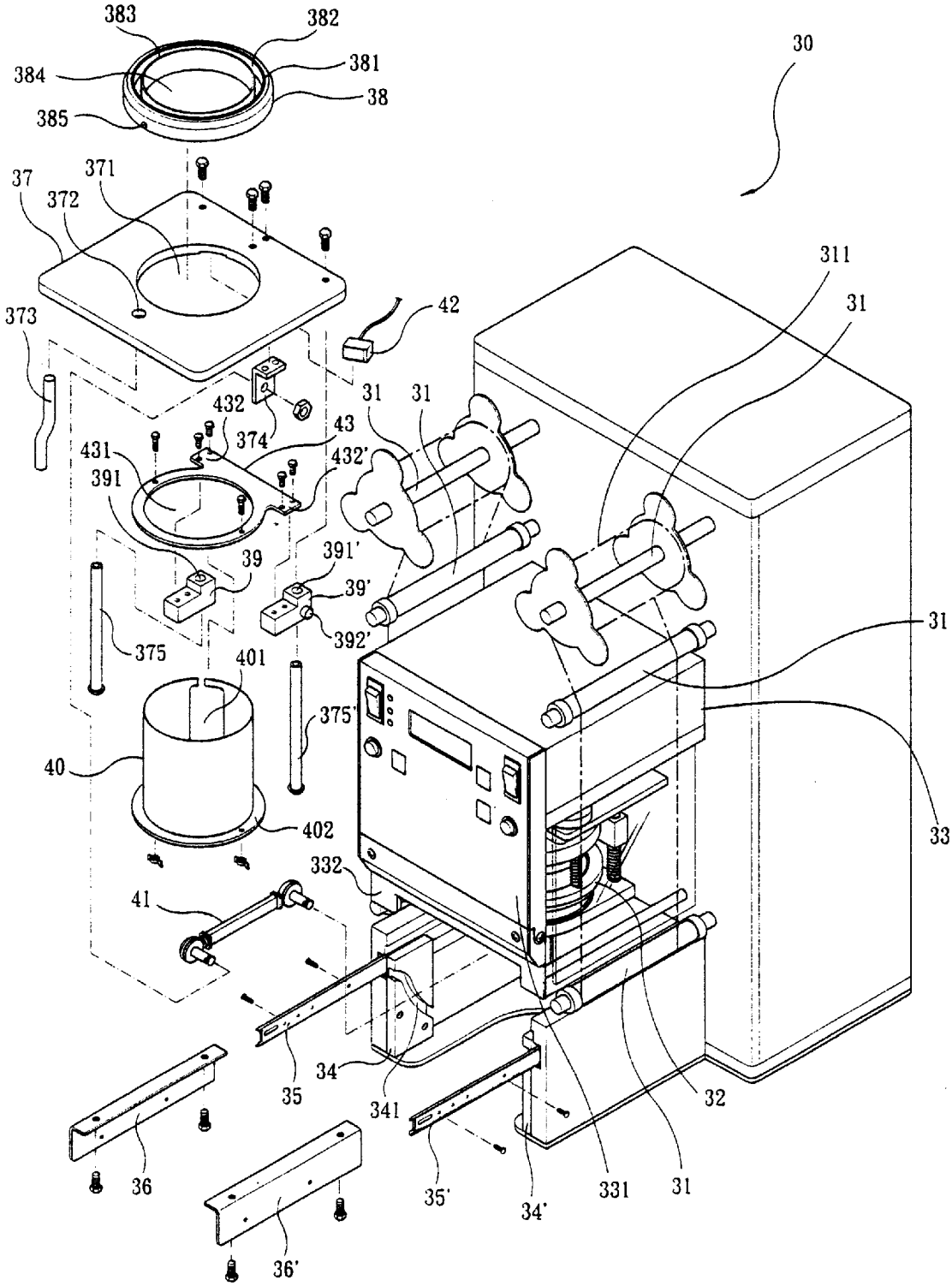
FIG. 5 is a perspective exploded view of a sealing device in accordance with the present invention.
Figure 6:
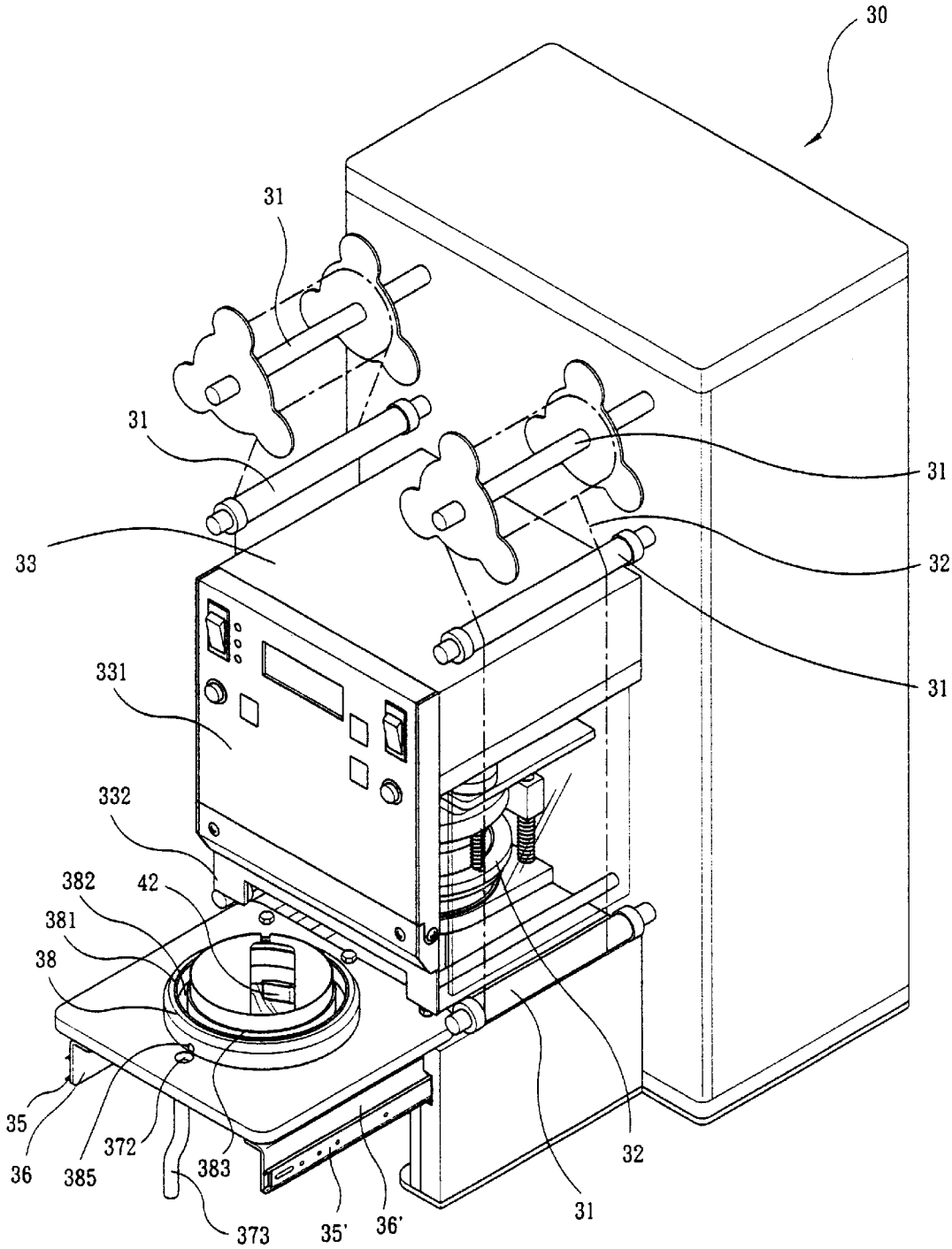
FIG. 6 is a perspective view of the sealing device in accordance with the present invention.
Figure 7:
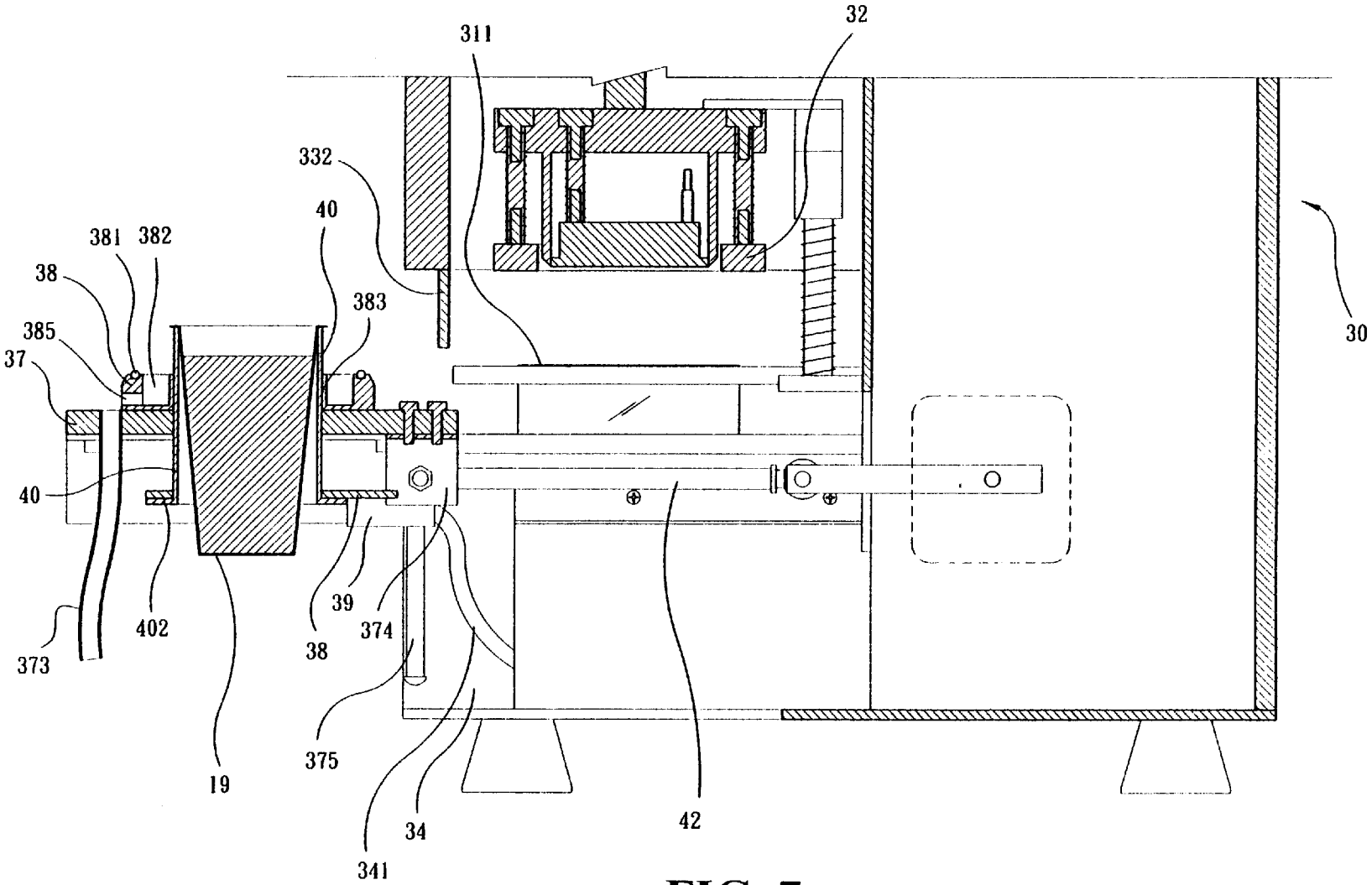
FIG. 7 is a sectional schematic view showing the cup placing seat being pushed to the external of the sealing device in accordance with the present invention.
Figure 8:
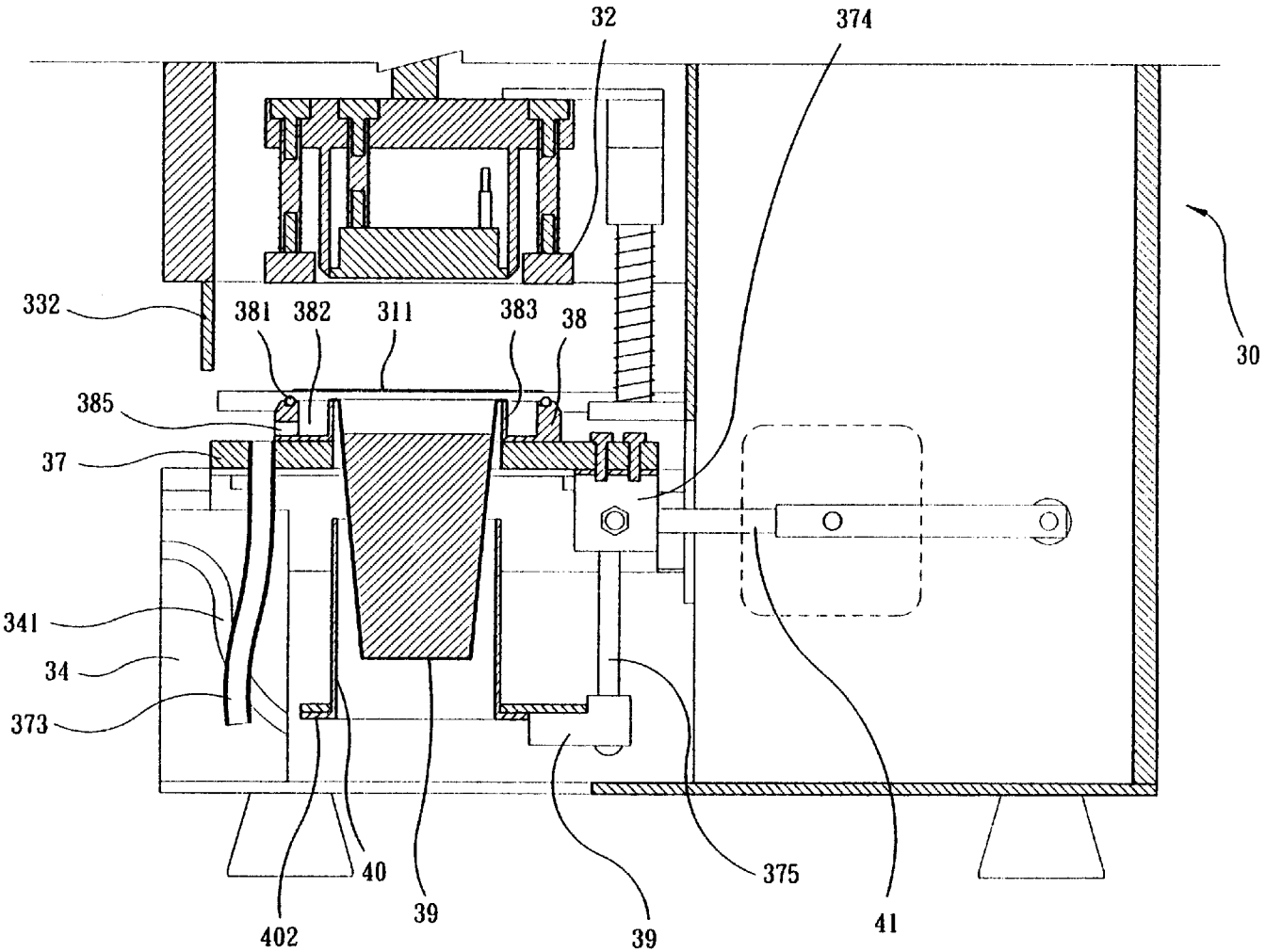
FIG. 8 is a sectional schematic view showing the cup placing seat being pushed to the sealing device in accordance with the present invention.
Figure 9:
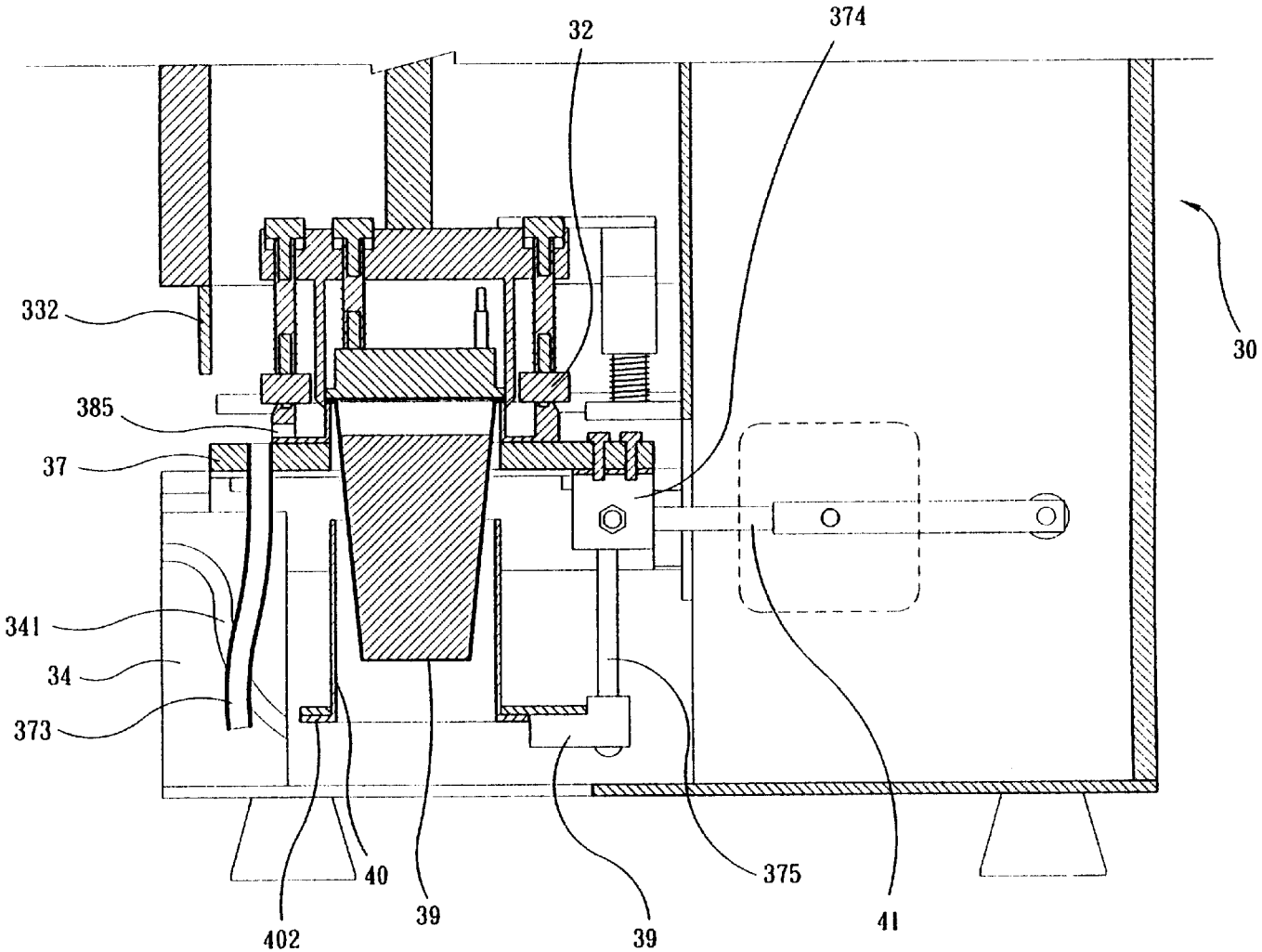
FIG. 9 is a schematic sectional view showing the cup placing seat during the thermal pressing process in accordance with the present invention.
Figure 10:
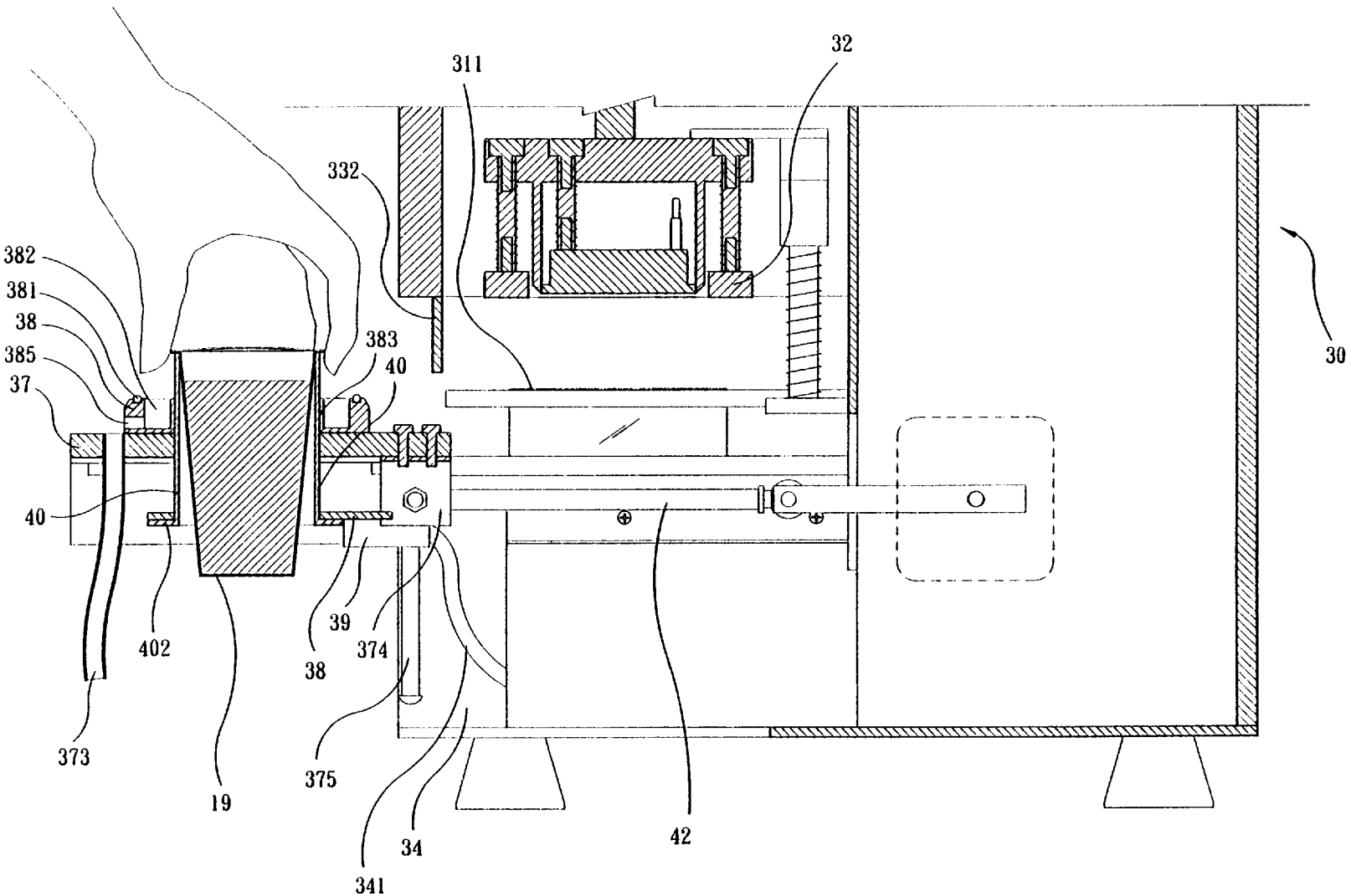
FIG. 10 is a sectional view showing the cup placing seat being pushed out of the sealing device in accordance with the present invention.
Figure 11:
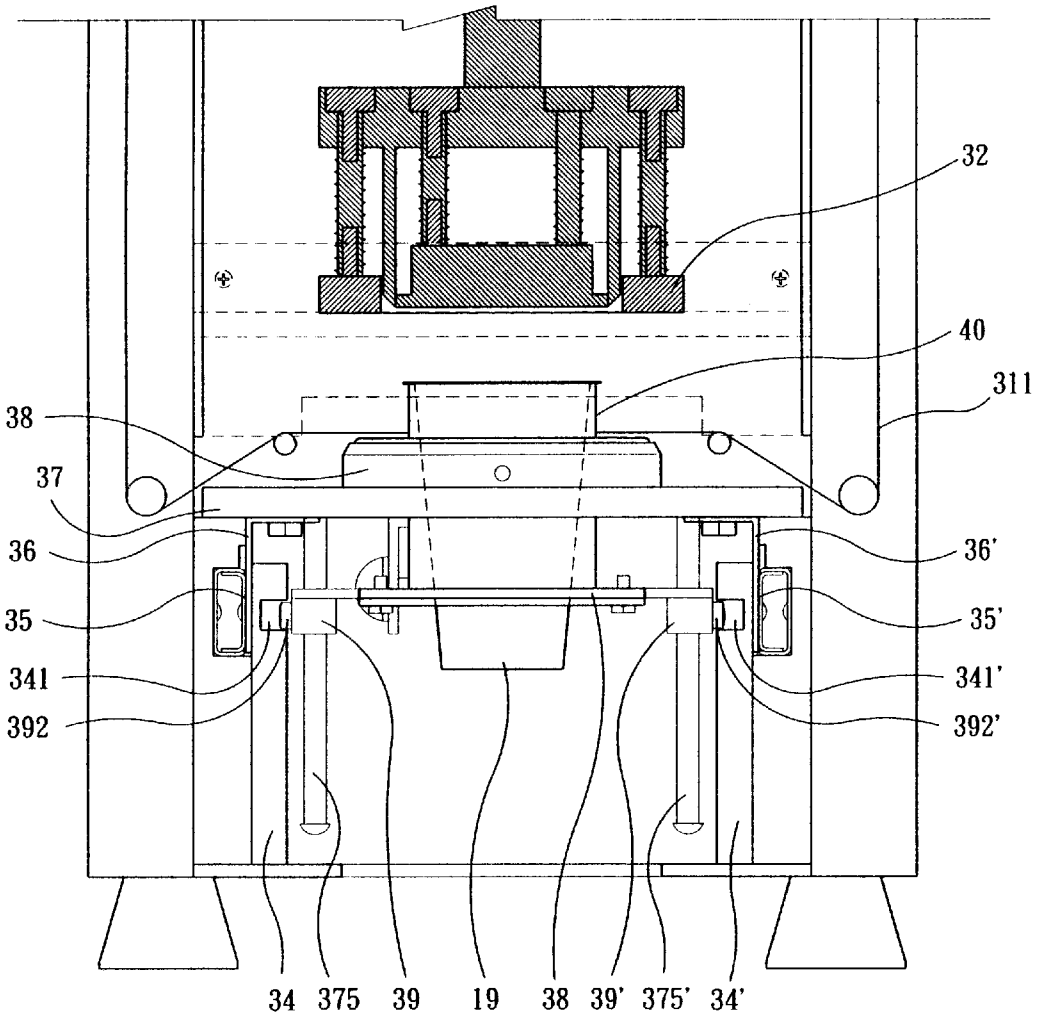
FIG. 11 is a partial sectional schematic view showing the cup placing seat being pushed to the external of the sealing device in accordance with the present invention.
Figure 12:
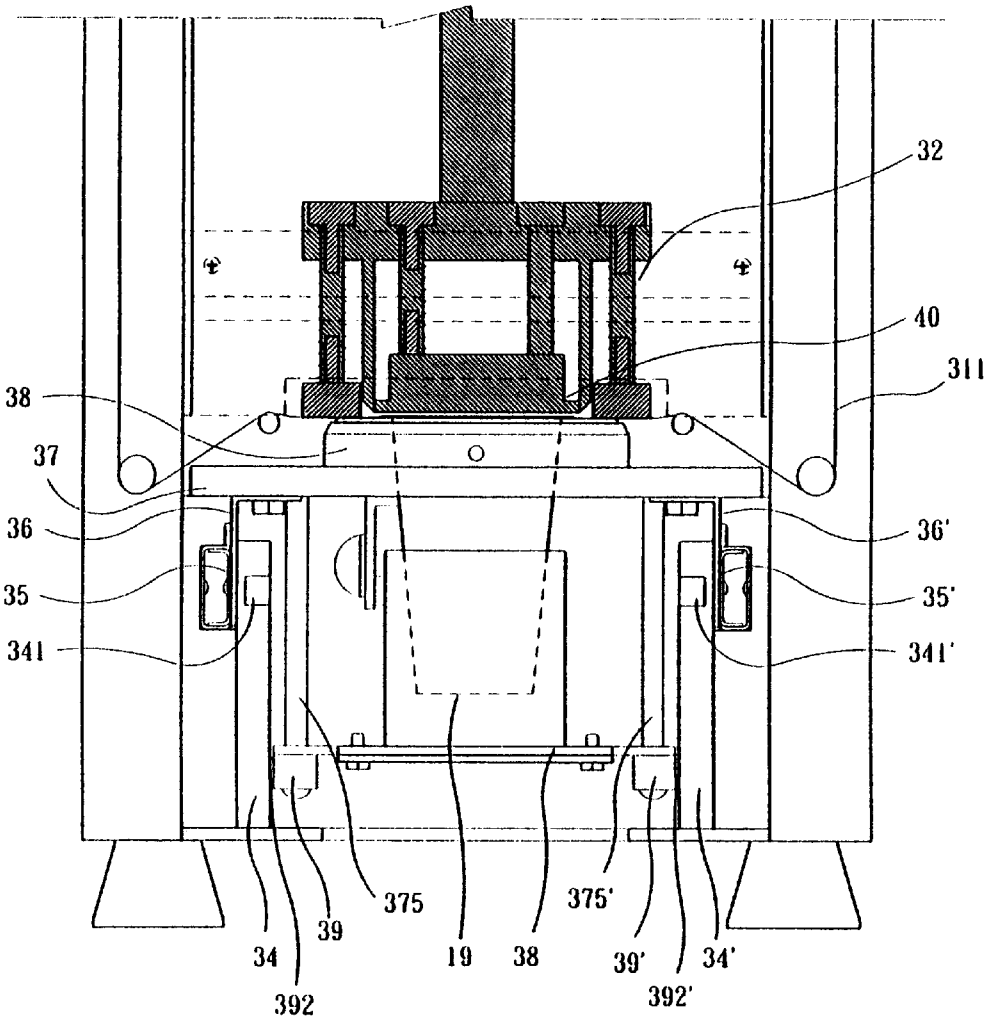
FIG. 12 is a schematic partial sectional view of the cup placing seat during the thermal pressing process in accordance with the present invention.

Referring to FIGS. 5 and 6, there is shown a sealing device 30 having a control box 33, a thermal pressing mechanism 32 and a plurality of securing rods 31. The securing rods 31 are provided at the two sides at the bottom of the thermal pressing mechanism 32. One side of the securing rod 31 is mounted with a film 311 and after the downward film-pulling end of the film 311 surrounds the securing rod 31, it is mounted onto the securing rod 31.

The securing rod 31 at the other side can be rotated to wind the remaining of the film thereon. The front of the control box 33 is provided with a control panel 331 being provided with a safety blocking plate 332 beneath the control panel 331 so as to prevent the hands of the user to enter a thermal pressing mechanism 32. The thermal pressing mechanism 32 is being mounted below the control box 33 and the two side walls of the main body of the sealing device 30 are engaged with a sliding rail 35 having a front section being a holding platform 37. The center position of the holding platform 37 is a through hole 371 and the external edge of the through hole 371 is a cup-placing seat 38, and the holding platform 37 is connected to a transmission rod 41 and the transmission rod 41 causes the holding platform 37 to move out from the main body or being pulled back to the main body. The lateral wall of the main body is located at the sliding rails 35, 35' and is provided with a block body having a forward elevating sliding slot and the cup holding seat 38 is provided with a through bole 384 and the through hole 384 has a size smaller than a hollow cylindrical body 40. The bottom face of the hollow cylindrical body 40 is protruded with two protruded securing sections 432, 432', having provided each with an elevating and lowering block 39, 39' for mounting. The vertical through hole is formed at the elevating and lowering block, and the through hole is positioned at the two ends at the bottom face of the holding platform 37, and the bottom end of the cylindrical body 40 has a larger surface and the external side of the elevating and lowering device has a shaft with pulley 392, 392'. When the holding platform 37 is driven to/or away from the main body, the individual pulleys 392, 392' enter the sliding slot 341, 341' and cause the second hollow cylindrical body 40 to move upward or downward. If the hollow cylindrical body 40 moves upward, the sealed cups are lifted up and when at lowering, the edge, of the cup is placed onto the through hole 384 of the cup-placing seat 38 to proceed with next sealing.

A cornered plate seat 36, 36' is provided at a middle position of the bottom of the rear side of the placing platform 37 and the cornered plate seat 36, 36' is connected with a transmission shaft 41 and the front edge of the through hole 371 of the placing platform 37 is provided with an opening 372 for mounting with a liquid discharging tube 373, the edge of the through hole 371 is provided with a cup-placing seat 37 having a recessed slot 382 at the upper end ring, and a cup-placing ring 383 is formed at the through hole 371 and the recessed slot 382, and a silicon rubber ring 381 is provided at the outer edge of the recessed slot 382, and the external ring face of the cup-placing seat 38 is provided with an opening aligned with the opening of the placing platform 37. The through hole 384 of the cup-placing seat 38 is provided with a hollow cylindrical body 40 having a radius smaller than that of the cup-placing ring 383. The ring face of the hollow cylindrical body is provided with a notch for a sensor to sense the presence of a cup, and the bottom end of the hollow cylindrical body is provided with a protruded edge at the external ring, and the protruded edge is mounted with a ring-like securing plate having a through hole, and the rear side of the securing plate is extended to two securing sections having respectively secured to a lifting and lowering block.

In accordance with the present invention, the two elevating and lowering blocks 39, 39' are respectively provided with a vertical through hole 391, 391'. The through holes 391, 391' can be mounted to two circular rods 375, 375' at the two ends of the bottom face at the rear side of the holding platform 37, and the two elevating and the lowering blocks 39, 39' are moveable along the circular rods 375, 375'.

The external sides of the elevating and lowering blocks 39, 39' are respectively mounted with pulley 392 (not shown), 392'. The pulley 392, 392' move forward with the holding plate 37 and can enter into the sliding recess 341, 341'.

Figure 13:
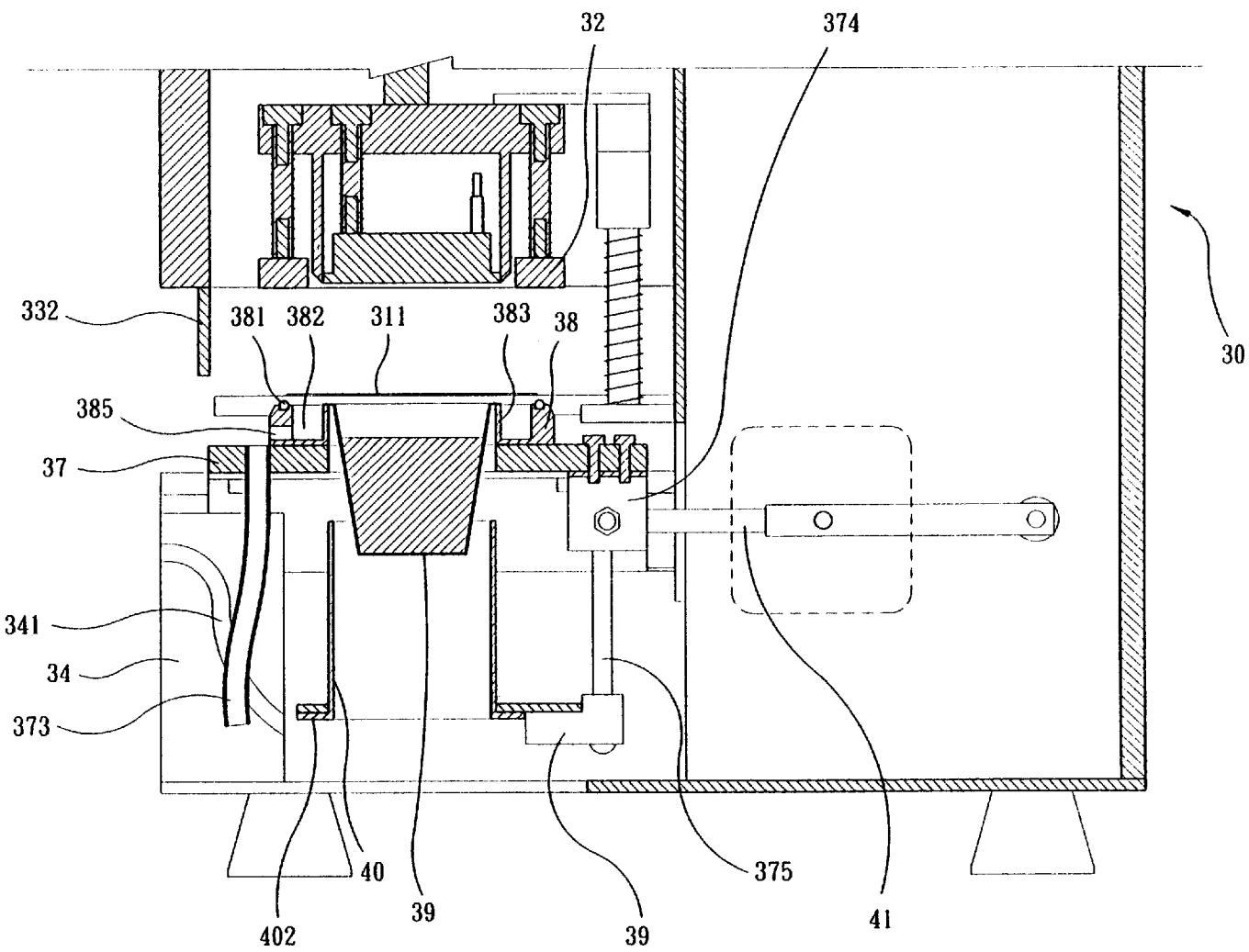
FIG. 13 is a sectional schematic view showing the thermal pressing process for higher cups in accordance with the present invention.
Figure 14:
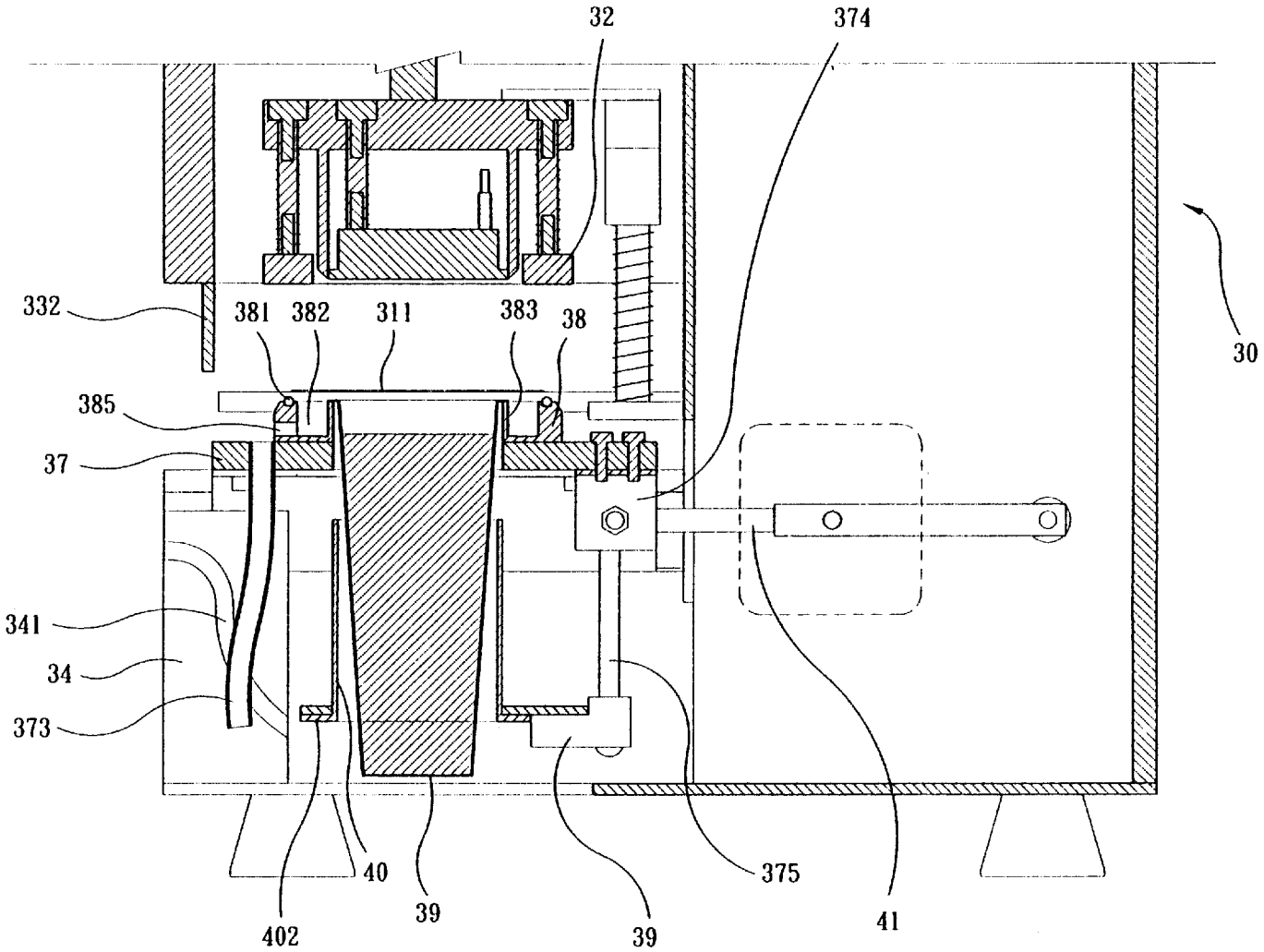
FIG. 14 is a sectional schematic view showing the thermal pressing process for shorter cups in accordance with the present invention.

FIGS. 7 to 12 show the function of the sealing device in accordance with the present invention. In the thermal pressing process, the holding platform 37 is pushed to the outside of the main body by the driving rod 42, and the two elevating and lowering blocks 39, 39' move upward along the sliding slot 341, 341' to the top of the circular pillars 375, 375'. When cups 19 are placed within the hollow cylindrical body 40, the cup edge of the cup 19 is placed at the top end of the body 40. The bottom section of the body 40 is an opening which can be used for short and tall cup. As shown in FIGS. 13 and 14, when the sensor 42 (not shown) senses a cup 19, the driving rod 42 moves and the placing platform 37 is pulled to the bottom of the thermal pressing mechanism 32, and the pulleys 392, 392' are lowered to the cup-placing seat 38 together with the hollow cylindrical body 40. When the thermal pressing mechanism 32 is pressed downward, the film 311 will contact with the cup edge and adhere therewith and the film is cut outside the cup edge, and the sealing process is completed. At this stage, the driving rod 41 will push the placing platform 37 to outside of the body and the placing platform 37 moves forward and the pulleys of the two blocks 39, 39' enter the sliding slots 341, 341' and are lifted to the top of the circular pillar 375, 375'. At the same time, the cup 19 at the top end of the cup ring 383 is lifted and the user can get the cup edge with one hand, and the other hand cap, place a cup for sealing to the hollow cylindrical body to process with next sealing process.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A sealing device for a disposable cup having a main body with a plurality of corresponding securing, rods mounted at the two sides of the front thereof, and one side of the securing rod for mounting with a rolled film and the downward pull film end being surrounded to the securing rod and then being mounted onto the securing rod, a control box having a control panel being provided with a safety blocking plate beneath the control panel, a then al pressing mechanism being mounted below the control box and the two side wall of the main body being engaged with a sliding rail having a front section being a holding platform, the center position of the holding platform being a through hole and the external edge of the through hole being a cup-placing seat, and the holding platform being connected to a transmission rod and the transmission rod caused the holding platform to move out from the main body or being pulled back to the main body characterized in that the lateral wall of the main body is located at the sliding rail and is provided with a block body having a forward elevating sliding slot and the cup holding seat is provided with a through hole and the through hole has a size smaller than a hollow cylindrical body, and the bottom face of the hollow cylindrical body is protruded with two protruded securing sections, having provided each with an elevating and lowering block for mounting, a vertical through hole is obtained at the elevating and lowering block, and the through hole is positioned at the two ends at the bottom face of the holding platform, and the bottom end of the cylindrical body has a larger surface and the external side of the elevating and lowering device has a shaft with pulley, when the holding platform is driven to/or away from the main body, the individual pulleys center the sliding slot and cause the second hollow cylindrical body to move upward or downward, if the hollow cylindrical body moves upward, the sealed cups are lifted up and when at lowering, the edge of the cup is placed onto the through hole of the cup-placing seat to proceed with next sealing.

2. The sealing device of claim 1, wherein a cornered plate seat is provided at a middle position of the bottom of the rear side of the placing platform and the cornered plate seat is connected with a transmission shaft and the front edge of the through hole of the placing platform is provided with an opening for mounting with a liquid discharging tube, the edge of the through hole is provided with a cup-placing seat having a recessed slot at the upper end ring, and a cup-placing ring is formed at the through hole and the recessed slot, and a silicon rubber ring is provided at the outer edge of the recessed slot, and the external ring face of the cup-placing seat is provided with an opening aligned with the opening of the placing platform.

3. The sealing device of claim 1, wherein the ring face of the hollow cylindrical body is provided with a notch for a sensor to sense the presence of a cup, and the bottom end of the hollow cylindrical body is provided with a protruded edge at the external ring, and the protruded edge is mounted with a ring-like securing plate having a through hole, and the rear side of the securing plate is extended to two securing sections having respectively secured to a lifting and lowering block.

* * * * *